United States Patent [19]

Januschkowetz et al.

[11] 4,371,573

[45] Feb. 1, 1983

[54] ELECTROLESS DEPOSITION OF NICKEL COATINGS AND DEPOSITING BATHS THEREFOR

[75] Inventors: Herbert Januschkowetz; Hans Laub, both of Nuremberg, Fed. Rep. of Germany

[73] Assignee: Siemens Aktiengesellschaft, Munich, Fed. Rep. of Germany

[21] Appl. No.: 322,547

[22] Filed: Nov. 18, 1981

[30] Foreign Application Priority Data

Dec. 30, 1980 [DE] Fed. Rep. of Germany ..... 3049417

[51] Int. Cl.[3] ..... C23C 3/02

[52] U.S. Cl. ..... 427/438; 106/1.22; 106/1.27

[58] Field of Search ..... 427/438; 106/1.27, 1.22

[56] References Cited

U.S. PATENT DOCUMENTS 2,916,401 12/1959 Puls ..... 427/438
3,152,009 10/1964 De Long ..... 427/438

FOREIGN PATENT DOCUMENTS 1378458 12/1974 United Kingdom .
1448831 8/1976 United Kingdom .
1507965 4/1978 United Kingdom .

OTHER PUBLICATIONS

Gawrilov, G. G., *Chemical (Electroless) Nickel Platins,* Published by Portcullis Press, 1979, pp. 117–118.

*Primary Examiner*—John D. Smith
*Attorney, Agent, or Firm*—Kenyon & Kenyon

[57] ABSTRACT

The electroless deposition of nickel coatings on metals and metal alloy is accomplished with aqueous baths which contain 10–50 g/l of a fluorine-containing nickel compound; 40 to 200 g/l diammonium hydrogen citrate; 20 to 100 g/l ammonium hydrogen difluoride; 5 to 50 g/l 2-hydroxy-4-methyl benzoic acid, (2,4-cresotinic acid); 0.0005–0.05 g/l copper salt; and 10–100 g/l sodium hypophosphite. Nickel fluoride and nickel (II)-hydroxide carbonate dissolved in hydrofluoric acid have been found particularly advantageous. Smooth and uniform, corrosion-resistant coatings are obtained also on complicated formed parts of magnesium and magnesium alloys.

5 Claims, No Drawings

ELECTROLESS DEPOSITION OF NICKEL COATINGS AND DEPOSITING BATHS THEREFOR

BACKGROUND OF THE INVENTION

The present invention relates to a method for the electroless deposition of nickel coatings on surfaces of metals and metal alloys and to an aqueous depositing bath therefor containing a nickel compound, complex salts, sodium hypophosphite, and copper salt.

The electroless deposition of nickel is a well-known and frequently used process. Electroless deposition processes and baths therefor and known, as evidenced, for example, in Britsh Pat. Nos. 1,378,458; 1,448,831 and 1,507,965. The baths described in these patents are suitable for electroless nickel plating of steel, non-ferrous metals, aluminum, plastics and ceramics. However, it was not possible to obtain faultless nickel coatings having good corrosion protection using these baths for the coating of magnesium or magnesium alloys.

Resort to further measures heretofore employed for corrosion protection of magnesium and magnesium alloys (MgAl6Zn and GD-MgAl9Znl) was successful. Chromatizing according to the BAS-process and black chromatizing yielded somewhat improved, yet still unsatisfactory, corrosion protection for magnesium and magnesium alloys; moreover, such coatings display low abrasion resistance.

SUMMARY OF THE INVENTION

It is therefore an object of the present invention to provide a bath for the electroless deposition of nickel on surfaces of metal and metal alloys, particularly of magnesium and magnesium alloys, in which the disadvantages described above do not occur, and with the aid of which it is possible to generate in a simple and economical manner completely dense nickel coatings. The coatings should further have an improved appearance and be free of surface defects.

This and other objects are attained with a bath which, according to the invention, comprises (a) 10 to 50 g/l of a flourine-containing nickel compound; (b) 40 to 200 g/l diammonium hydrogen citrate; (c) 20 to 100 g/l ammonium hydrogen diflouride; (d) 5 to 50 g/l 2-hydroxy-4-methyl benzoic acid (2,4-cresotinic acid); (e) 0.0005 to 0.05 g/l copper salt; and (f) 10 to 100 g/l sodium hypophosphite. Particularly preferred is a bath that contains 10 to 15 g/l $NiF_2.4H_2O$ or the corresponding quantity of $NiF_2$. For some puposes, a bath containing 10 to 50 g/l nickel hydroxide carbonate dissolved in hydrofluoric acid has been found particularly advantageous.

The bath according to the present invention can be operated continuously, and has been found to be particularly suitable for the electroless nickel plating of magnesium and magnesium alloys. The nickel coatings obtained on work pieces of magnesium and magnesium alloys (pretreated in the known manner) are smooth, uniform and free of pores, even on work pieces with complicated shapes. The sheen is preserved. The corrosion resistance of magnesium parts which are protected with such coatings is excellent. For example, magnesium parts which are protected by a layer of 10 μm copper and 15-20 μm nickel from the bath according to the present invention showed no corrosion of the base metal of any kind after a 21-day stress in a damp heat alternating atmosphere (SFW DIN 50017).

The present invention further provides a method for the electroless deposition of nickel coatings, using a bath of the composition given above, which is characterized by the feature that the bath is operated at pH-value of about 7-8, preferably about 7.3, and at a bath temperature of 80°-97° C. The pH-value can be maintained within the desired range in a known manner by the addition of suitable bases. With a bath temperature of about 95° C., the deposition rate is approximately 15 μm/hour. The method according to the present invention also can be carried out by means of automatic equipment.

For the operation of the bath, the procedure known from German Pat. No. 27 44 426 has been found advantageous. Following this procedure, volume components are taken from the bath at periodic time intervals of 5-10 minutes and replaced by water and make-up solutions (nickel complex salt solution, reducing agent solution) such that the bath density is always maintained at a value of 7-15 Bé (1.051-1.116 g/cm$^3$) and preferably at 13° Bé (1.099 g/cm$^3$). The amount of make-up solutions is apportioned so that the loss of nickel, reducing agent and the other bath components which are produced by the nickel deposition and the volume exchange, is continuously compensated so that the bath composition and, therefore, also the plating properties, remain essentially constant.

The bath according to the present invention is particularly well suited for nickel-plating magnesium and magnesium alloy work pieces of complicated shape, for example, positioners for record storage devices.

DETAILED DESCRIPTION OF THE INVENTION

The present invention is explained in greater detail through the following example.

EXAMPLE 1

Parts of positioners of a record storage device of AlMg6Zn are nickel-plated in an electroless manner, after the customary pre-treatment by degreasing, pickling, copper flashing (approx. 10 μm Cu), in a bath of the following basic composition:

| Compound | Formula | Quantity |
|---|---|---|
| Nickel fluoride | $NiF_2.4H_2O$ or $NiF_2$ | 26 g/l (corres. to 15 g/l 9 g/l Ni) |
| Diammonium Hydrogen Citrate | $C_6H_{14}N_2O_7$ | 60 g/l |
| Ammonium Hydrogen Difluoride | $NH_4HF_2$ | 40 g/l |
| 2-hydroxy-4-methyl benzoic acid | $C_8H_8O_3$ | 6 g/l |
| Copper (II) fluoride | $CuF_2$ | 0.001 g/l |
| Sodium hypophosphite | $NaH_2PO_2.H_2O$ | 20 g/l |
| Operating Data of the bath: | | |
| pH value: 7.2-7.5 | | |
| bath temperature: 95° C.-97° C. | | |
| Area loading: 1 dm$^2$/l | | |
| Deposition rate: 15 μm/hour | | |

At periodic time intervals of 5-10 minutes, so much electrolyte is removed from the bath and replaced by make-up solutions in the form of a nickel complex salt solution, a reducing agent solution and water, that the losses of nickel, reducing agent and the other bath components due to the nickel deposition and the volume exchange are compensated for, and the bath density as well as the bath volume remain constant.

EXAMPLE 2

Parts of the positioner of a record storage device of GD-MgAl9Znl are nickel-plated after a customary pretreatment by degreasing, pickling, and copper flashing (about 10 μm Cu) in a bath of the following basic composition:

| Compound | Formula | Quantity |
|---|---|---|
| Nickel (II) hydroxide carbonate | $NiCO_3.Ni(OH)_2.4H_2O$ | 20 g/l (corres. to 9 g/l Ni dissolved in 15 $cm^3$ 40% - hydrofluoric acid) |
| Diammonium hydrogen citrate | $C_6H_{14}N_2O_7$ | 60 g/l |
| Ammonium hydrogen difluoride | $NH_4HF_2$ | 40 g/l |
| 2-hydroxy-4-methyl benzoic acid | $C_8H_8O_3$ | 6 g/l |
| Copper (II) acetate | $(CH_3COO)_2Cu.H_2O$ | 0.001 g/l |
| Sodium hypophosphite | $NaH_2PO_2H_2O$ | 20 g/l |
| | Operating Data of the bath: | |
| | pH value: 7.4–7.8 | |
| | bath temperature: 95° C.–97° C. | |
| | Area loading: 1 $dm^2$/l | |
| | Deposition rate: 15 μm/hour | |

At periodic time intervals of 5–10 minutes, so much electrolyte is removed from the bath and replaced by make-up solutions in the form of a nickel complex salt solution, a reducing agent solution and water, that the losses of nickel, reducing agent and the other bath components caused by nickel deposition and volume exchange are compensated for and the bath density as well as the bath volume remain constant.

What is claimed is:

1. A depositing bath for the electroless deposition of nickel on surfaces of metal and metal alloys comprising an aqueous solution containing (a) from about 10 to about 50 g/l of a flourine-containing nickel compound; (b) from about 40 to about 200 g/l diammonium hydrogen citrate; (c) from about 20 to about 100 g/l ammonium hydrogen difluoride; (d) from about 5 to about 50 g/l 2-hydroxy-4-methyl-benzoic acid; (e) from about 0.0005 to about 0.05 g/l copper salt; and (f) from about 10 to about 100 g/l sodium hypophosphite.

2. The bath according to claim 1 wherein said fluorine-containing nickel compound is nickel fluoride.

3. The bath according to claim 1 wherein said fluorine-containing nickel compound is nickel (II) hydroxide carbonate dissolved in hydrofluoric acid.

4. A method for the electroless depositing of a nickel coating on a metal or metal alloy, comprising immersing said metal or metal alloy in the bath of claim 1 while maintaining said bath at a temperature of from about 80° to 97° C. and at a pH of from about 7 to 8.

5. The method according to claim 4 wherein said metal or metal alloy is magnesium or magnesium alloy.

* * * * *